US009889059B2

(12) United States Patent
Arakawa

(10) Patent No.: US 9,889,059 B2
(45) Date of Patent: Feb. 13, 2018

(54) FINGER JOINT DRIVING DEVICE

(71) Applicant: Seiko Epson Corporation, Tokyo (JP)

(72) Inventor: Yutaka Arakawa, Hara (JP)

(73) Assignee: Seiko Epson Corporation (JP)

( * ) Notice: Subject to any disclaimer, the term of this patent is extended or adjusted under 35 U.S.C. 154(b) by 411 days.

(21) Appl. No.: 14/635,174

(22) Filed: Mar. 2, 2015

(65) Prior Publication Data

US 2015/0245972 A1 Sep. 3, 2015

(30) Foreign Application Priority Data

Mar. 3, 2014 (JP) ..... 2014-040155
Mar. 17, 2014 (JP) ..... 2014-053136

(51) Int. Cl.
*A61H 1/00* (2006.01)
*A61H 1/02* (2006.01)

(52) U.S. Cl.
CPC ... *A61H 1/0288* (2013.01); *A61H 2201/1207* (2013.01); *A61H 2201/14* (2013.01); *A61H 2201/165* (2013.01); *A61H 2201/1635* (2013.01); *A61H 2201/1676* (2013.01)

(58) Field of Classification Search
CPC ..... A61H 1/0288; A61H 2201/14; A61H 2201/1207; A61H 2201/1676; A61H 2201/165; A61H 2201/1635
See application file for complete search history.

(56) References Cited

U.S. PATENT DOCUMENTS 5,328,448 A * 7/1994 Gray, Sr. ..... A61H 1/0288 482/44
5,376,091 A * 12/1994 Hotchkiss ..... A61B 17/62 602/22
6,502,577 B1 * 1/2003 Bonutti ..... A61F 5/013 128/898
8,425,438 B2 4/2013 Fujimoto et al.
8,668,659 B2 3/2014 Kawakami
2009/0248202 A1 10/2009 Osuka et al.
2010/0249676 A1 9/2010 Kawakami
2012/0004588 A1 1/2012 Bonutti
2015/0164660 A1 * 6/2015 Will ..... A61F 2/68 623/26
2015/0223959 A1 * 8/2015 Cempini ..... A61H 1/0285 602/22

(Continued)

FOREIGN PATENT DOCUMENTS

JP 11-253504 A 9/1999
JP 2002-345861 A 12/2002

(Continued)

*Primary Examiner* — Steven Douglas
(74) *Attorney, Agent, or Firm* — Harness, Dickey & Pierce, P.L.C.

(57) ABSTRACT

A finger joint driving device is provided on a hand and causes a finger joint to be turned. The finger joint driving device includes a first base portion that is mounted on the hand, a first link portion that is turnably provided on the first base portion, a second link portion that is turnably provided on the first link portion, a second base portion that is mounted on the end side of a finger from the first base portion in the hand and is provided on the second link portion so as to relatively approach with respect to and to be separated from the first base portion, and a driving unit that drives the second link portion to be turned.

11 Claims, 8 Drawing Sheets

(56) References Cited

U.S. PATENT DOCUMENTS

| | | | | |
|---|---|---|---|---|
| 2016/0015590 | A1* | 1/2016 | Arata | B25J 9/0006 623/64 |
| 2016/0296345 | A1* | 10/2016 | Deshpande | A61H 1/0288 |

FOREIGN PATENT DOCUMENTS

| | | | |
|---|---|---|---|
| JP | 2007-275486 | A | 10/2007 |
| JP | 2007-313093 | A | 12/2007 |
| JP | 2008-055544 | A | 3/2008 |
| JP | 2009-112578 | A | 5/2009 |
| JP | 2010-063723 | A | 3/2010 |
| JP | 2011-115248 | A | 6/2011 |
| JP | 2012-253990 | A | 12/2012 |
| JP | 2013-121189 | A | 6/2013 |
| JP | 2013-240464 | A | 12/2013 |

* cited by examiner

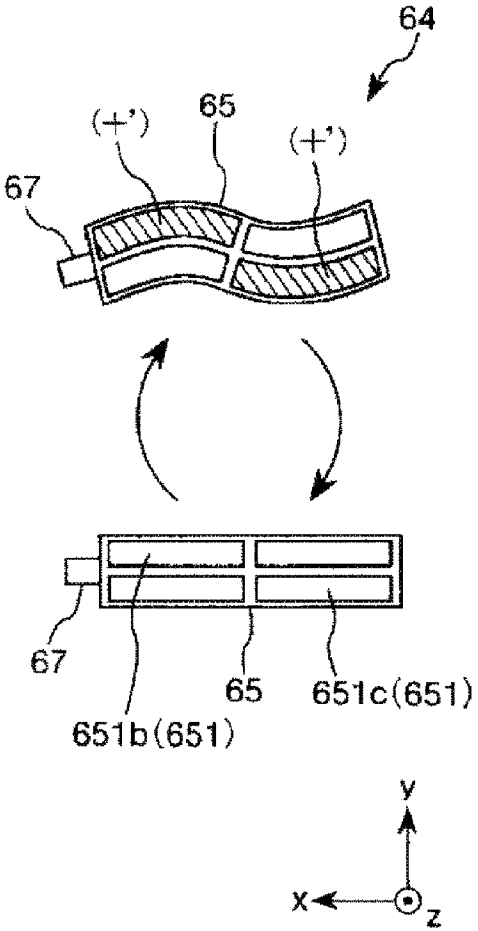
FIG. 5A
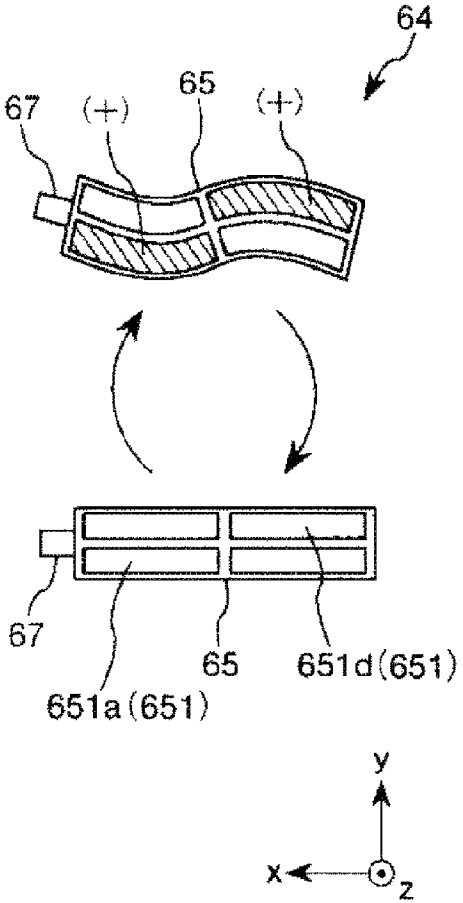
FIG. 5B
FIG. 5C

FINGER JOINT DRIVING DEVICE

BACKGROUND

1. Technical Field

The present invention is related to a finger joint driving device.

2. Related Art

A finger joint driving device which is mounted on a hand and assists movement of a finger in the mounted state, that is, which bends and stretches a finger joint has been known (for example, refer to JP-A-2002-345861). The finger joint driving device disclosed in JP-A-2002-345861 is provided with a slide bracket which is disposed on a back of the hand in the mounted state, a third connection member which is provided on the end side of the finger with respect to the slide bracket, and a third rear arm and a third front arm which are turnably provided with respect to the third connection member. In addition, the slide bracket slides, thus the third connection member slides, and together with this, the third rear arm and the third front arm turn in the opposite direction to each other, and thereby it is possible to bend the third joint of the finger.

However, in the finger joint driving device disclosed in JP-A-2002-345861, since the slide bracket is disposed on the back of the hand, the finger joint driving device is made thick as a whole. As a result, there is a problem in that when a user tries to put the hand in the mounted state into a relatively narrow gap, due to the finger joint driving device being mounted, the movement of the user is limited and, for example, the hand cannot be put into the gap.

SUMMARY

An advantage of some aspects of the invention is to provide a finger joint driving device capable of reducing the limitation of the movement of a user's hand when the user uses the finger joint driving device mounted on the hand.

The invention can be implemented as the following forms or application examples.

APPLICATION EXAMPLE 1

This application example is directed to a finger joint driving device which is provided on a hand and causes a finger joint to be turned, and includes: a first member that is mounted on the hand, a second member that is turnably provided on the first member, a third member that is turnably provided on the second member, a fourth member that is mounted on the end side of the finger from the first member and is provided on the third member so as to relatively approach with respect to and to be separated from the first member, and a first driving unit that drives at least one of the second member to be turned, the third member to be turned, and the fourth member to approach with respect to and to be separated from the first member.

With this configuration, it is possible to reduce the thickness of the finger joint driving device compared with a case where, for example, a member disposed on a back of the hand slides and thus a finger joint is allowed to bend and stretch. Thus, since the thickness of the finger joint driving device is reduced, it is possible to put the hand into a relatively narrow gap. Therefore, when using the finger joint driving device mounted on the hand, it is possible to reduce the limitation of the movement of a user's hand.

APPLICATION EXAMPLE 2

In the finger joint driving device according to the application example described above, it is preferable that the first member is disposed on the back of the hand and the fourth member is disposed on a knuckle of the finger.

With this configuration, according to a disposition state of the first member and the fourth member, it is possible to reliably turn the finger joint to be turned.

APPLICATION EXAMPLE 3

In the finger joint driving device according to the application example described above, it is preferable that the first member is disposed on the knuckle of the finger and the fourth member is disposed on a middle phalanx on the finger.

With this configuration, according to the disposition state of the first member and the fourth member, it is possible to reliably turn the finger joint to be turned.

APPLICATION EXAMPLE 4

In the finger joint driving device according to the application example described above, it is preferable that the first member is disposed on the middle phalanx of the finger and the fourth member is disposed on a distal phalanx of the finger.

With this configuration, according to the disposition state of the first member and the fourth member, it is possible to reliably turn the finger joint to be turned.

APPLICATION EXAMPLE 5

In the finger joint driving device according to the application example described above, it is preferable that the second member and the third member are turnable around an axis in parallel with a turning axis of the finger joint.

With this configuration, it is possible to reliably turn the finger joint to be turned.

APPLICATION EXAMPLE 6

In the finger joint driving device according to the application example described above, it is preferable that the first driving unit drives the second member to be turned.

With this configuration, it is possible to reliably perform the turning of the finger joint.

APPLICATION EXAMPLE 7

In the finger joint driving device according to the application example described above, it is preferable that the first driving unit drives the third member to be turned.

With this configuration, it is possible to reliably perform the turning of the finger joint.

APPLICATION EXAMPLE 8

In the finger joint driving device according to the application example described above, it is preferable that the first driving unit includes a piezoelectric element.

With this configuration, it is possible to make the configuration of the first driving unit, for example, a simple configuration using the piezoelectric element, thereby contributing to miniaturization and thickness reduction of the finger joint driving device.

APPLICATION EXAMPLE 9

It is preferable that the finger joint driving device according to the application example described above further includes a fifth member that is turnably provided on the fourth member, a sixth member that is turnably provided on the fifth member, and a seventh member that is mounted on the end side of the finger from the fourth member in the hand and is provided on the sixth member so as to relatively approach with respect to and to be separated from the fourth member.

With this configuration, it is possible to cause each of two finger joints to be turned.

APPLICATION EXAMPLE 10

It is preferable that the finger joint driving device according to the application example described above further includes a second driving unit that drives at least one of the fifth member to be turned, the sixth member to be turned, and the seventh member to approach with respect to and to be separated from the fourth member.

With this configuration, two finger joints are separated from each other or synchronized with each other and thus can be reliably turned.

APPLICATION EXAMPLE 11

This application example is directed to a finger joint driving device which is provided on a hand and causes a finger joint to be turned, and includes: a first member that is mounted on a hand, a second member that is turnably provided on the first member, a third member that is turnably provided on the second member, a fourth member that is mounted on the opposite side of the end side of the finger from the first member and is provided on the third member so as to relatively approach with respect to and to be separated from the first member, and a first driving unit that drives at least one of the second member to be turned, the third member to be turned, and the fourth member to approach with respect to and to be separated from the first member.

With this configuration, it is possible to reduce the thickness of the finger joint driving device compared with a case where, for example, a member disposed on a back of the hand slides and thus a finger joint is allowed to bend and stretch. Thus, since the thickness of the finger joint driving device is reduced, it is possible to put the hand into a relatively narrow gap. Therefore, when using the finger joint driving device mounted on the hand, it is possible to reduce the limitation of the movement of a user's hand.

The invention can also be implemented as the following application examples.

APPLICATION EXAMPLE 12

This application example is directed to a finger joint driving device which is provided on a hand and causes a finger joint to be turned, and includes: a first member that is mounted on the hand, a second member that is turnably provided on the first member, a third member that is provided on the second member so as to approach with respect to and to be separated from the first member, a fourth member that is mounted on the end side of the finger from the first member and is turnably provided on the third member, and a first driving unit that drives at least one of the second member to be turned, the third member to approach with respect to and to be separated from the first member, and the fourth member to be turned.

With this configuration, it is possible to reduce the thickness of the finger joint driving device compared with a case where, for example, a member disposed on a back of the hand slides and thus a finger joint is allowed to bend and stretch. Thus, since the thickness of the finger joint driving device is reduced, it is possible to put the hand into a relatively narrow gap. Therefore, when using the finger joint driving device mounted on the hand, it is possible to reduce the limitation of the movement of a user's hand.

APPLICATION EXAMPLE 13

In the finger joint driving device according to the application example described above, it is preferable that the first member is disposed on the back of the hand and the fourth member is disposed on a knuckle of the finger.

With this configuration, according to a disposition state of the first member and the fourth member, it is possible to reliably turn the finger joint to be turned.

APPLICATION EXAMPLE 14

In the finger joint driving device according to the application example described above, it is preferable that the first member is disposed on the knuckle of the finger and the fourth member is disposed on the middle phalanx on the finger.

With this configuration, according to the disposition state of the first member and the fourth member, it is possible to reliably turn the finger joint to be turned.

APPLICATION EXAMPLE 15

In the finger joint driving device according to the application example described above, it is preferable that the first member is disposed on the middle phalanx of the finger and the fourth member is disposed on a distal phalanx of the finger.

With this configuration, according to the disposition state of the first member and the fourth member, it is possible to reliably turn the finger joint to be turned.

APPLICATION EXAMPLE 16

In the finger joint driving device according to the application example described above, it is preferable that the second member and the fourth member are turnable around an axis parallel with a turning axis of the finger joint.

With this configuration, it is possible to reliably turn the finger joint to be turned.

APPLICATION EXAMPLE 17

In the finger joint driving device according to the application example described above, it is preferable that the first driving unit drives the second member to be turned.

With this configuration, it is possible to reliably perform the turning of the finger joint.

APPLICATION EXAMPLE 18

In the finger joint driving device according to the application example described above, it is preferable that the first driving unit drives the fourth member to be turned.

With this configuration, it is possible to reliably perform the turning of the finger joint.

APPLICATION EXAMPLE 19

In the finger joint driving device according to the application example described above, it is preferable that the first driving unit includes a piezoelectric element.

With this configuration, it is possible to make the configuration of the first driving unit, for example, a simple configuration using the piezoelectric element, thereby contributing to miniaturization and thickness reduction of the finger joint driving device.

APPLICATION EXAMPLE 20

It is preferable that the finger joint driving device according to the application example described above further includes a fifth member that is turnably provided on the fourth member, a sixth member that is provided on the fifth member so as to relatively approach with respect to and to be separated from the fourth member, and a seventh member that is turnably mounted on the sixth member.

With this configuration, it is possible to cause each of two finger joints to be turned.

APPLICATION EXAMPLE 21

It is preferable that the finger joint driving device according to the application example described above further includes a second driving unit that drives at least one of the fifth member to be turned, the sixth member to approach with respect to and to be separated from the fourth member, and the seventh member to be turned.

With this configuration, two finger joints are separated from each other or synchronized with each other and thus can be reliably turned.

BRIEF DESCRIPTION OF THE DRAWINGS

The invention will be described with reference to the accompanying drawings, wherein like numbers reference like elements.

FIGS. 5A through 5C are explanatory diagrams illustrating operating principles of the driving unit.

DESCRIPTION OF EXEMPLARY EMBODIMENTS

Figure 1:
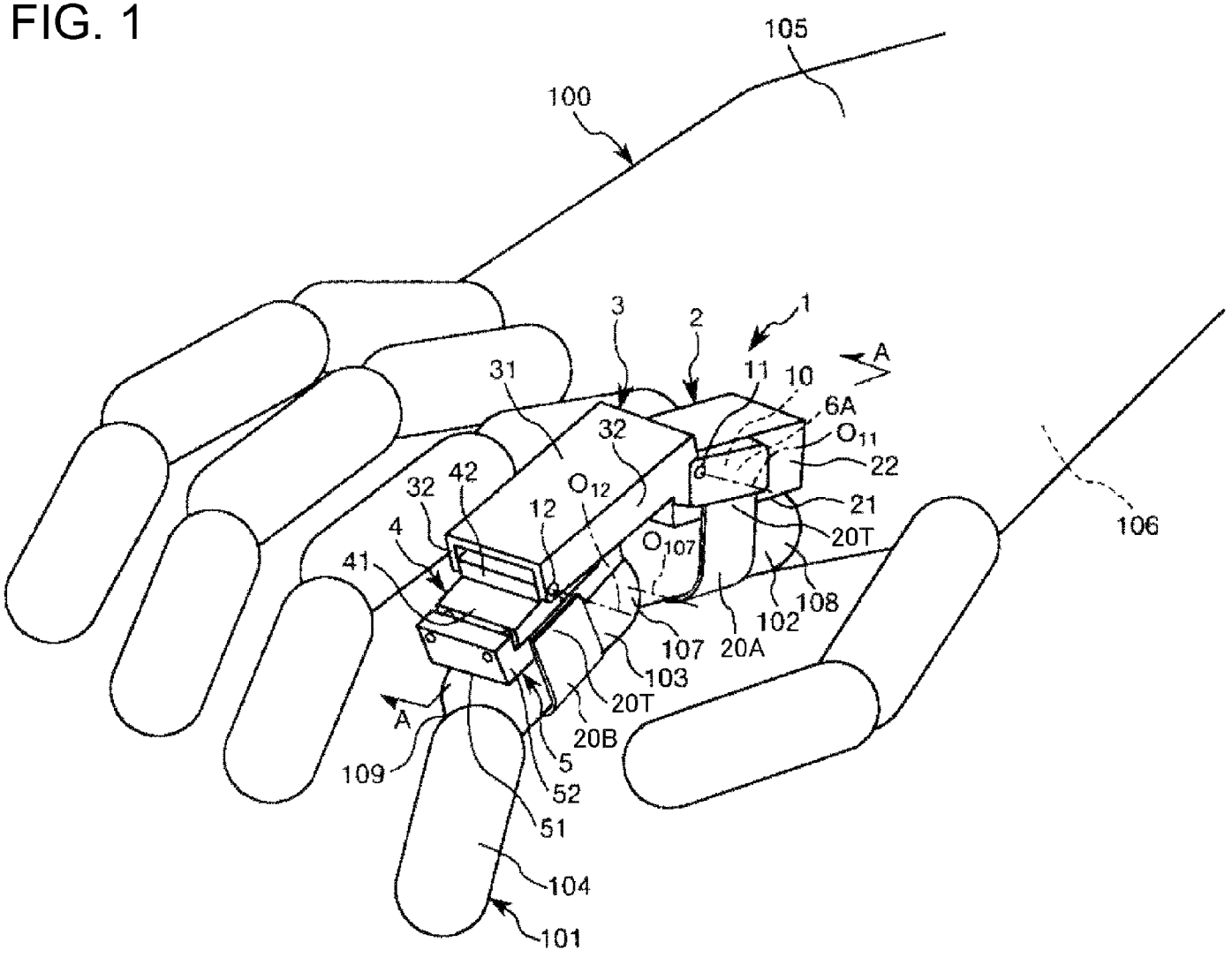
FIG. 1 is a perspective view illustrating a usage state of a finger joint driving device according to a first embodiment.

Hereinafter, preferable embodiments according to a finger joint driving device according to the invention will be described in detail with reference to the drawings. Meanwhile, with respect to a hand 100, a back of the hand 105 side is referred to as "up", "the upper surface", or the "upper side" and, a palm of the hand 106 side is referred to as "down", the "lower surface", or the "lower side" in the drawings.

First Embodiment

Figure 2:
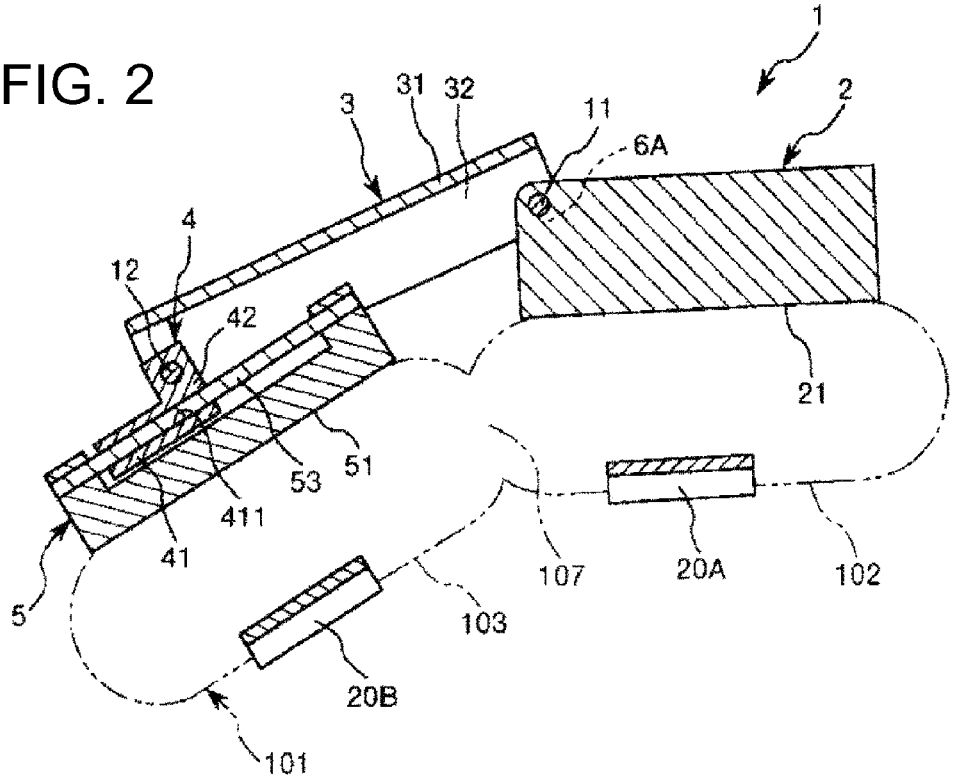
FIG. 2 is a cross-sectional view taken along line A-A in FIG. 1.
Figure 3:
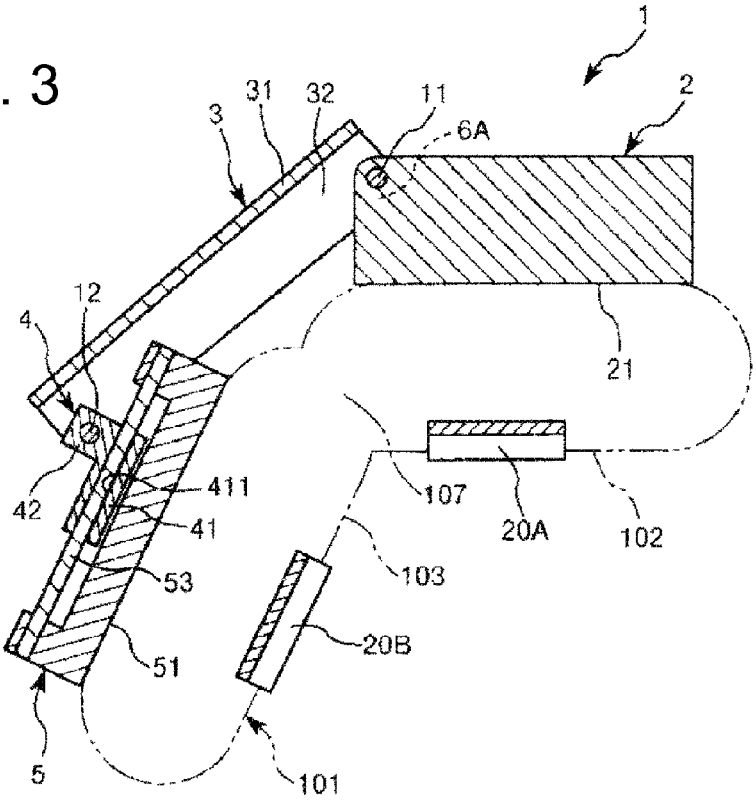
FIG. 3 is a cross-sectional view illustrating a finger which is bent in the state illustrated in FIG. 2.
Figure 4:
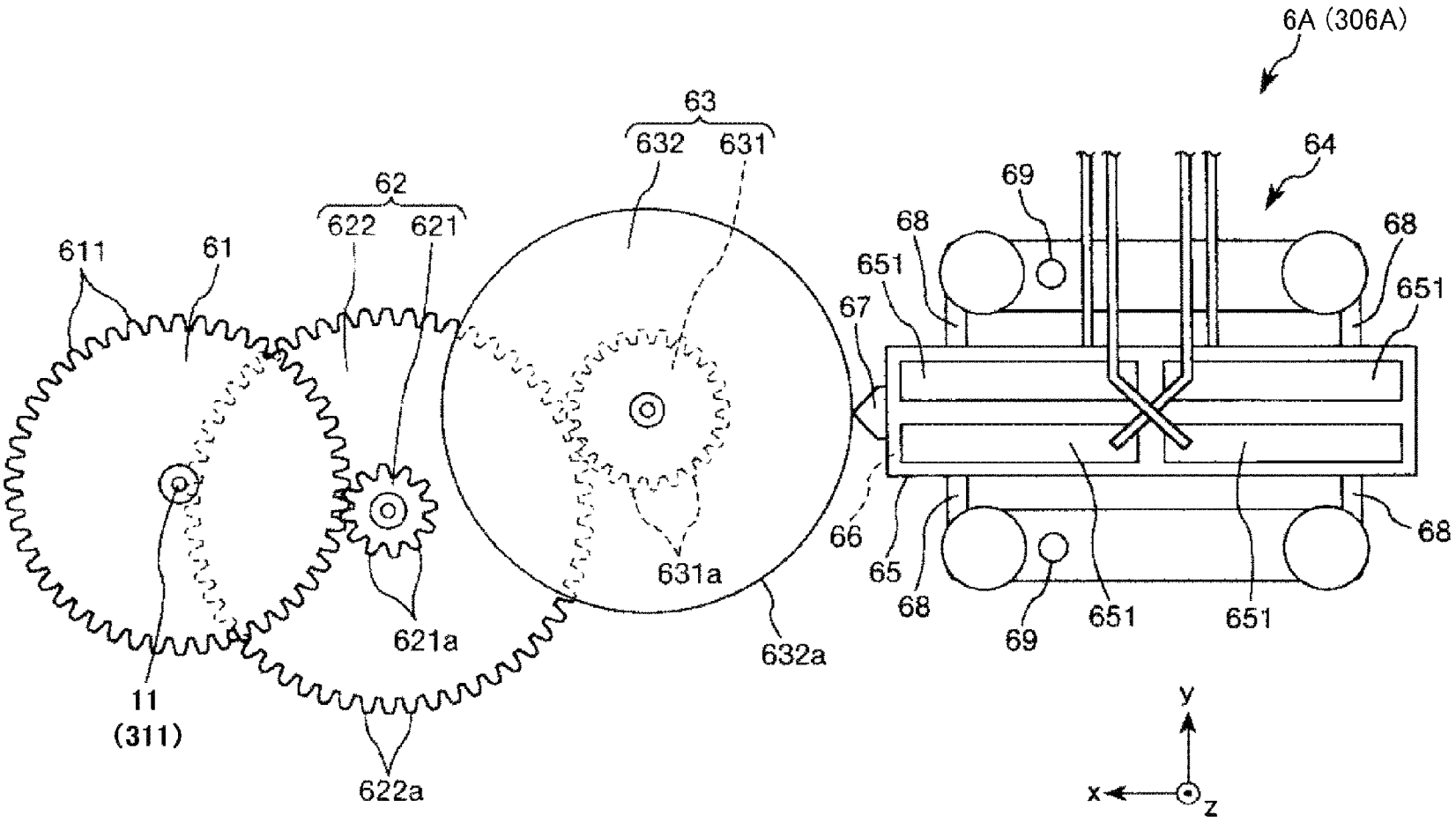
FIG. 4 is a plan view of a driving unit included in the finger joint driving device.

FIG. 1 is a perspective view illustrating a usage state of a finger joint driving device according to a first embodiment of the invention. FIG. 2 is a cross-sectional view taken along line A-A in FIG. 1. FIG. 3 is a cross-sectional view illustrating a finger which is bent in the state illustrated in FIG. 2. FIG. 4 is a plan view of a driving unit included in the finger joint driving device as illustrated in FIG. 1. FIGS. 5A to 5C are explanatory diagrams illustrating operating principles of the driving unit.

Meanwhile, hereinafter, for the sake of convenience of description, fingers are schematically illustrated, and the obliquely left downward side is referred to as the "end side of the finger" and the opposite side which is the obliquely right upward side is referred to as the "wrist side" in FIG. 1, and the left side is referred to as "the end side of the finger" and the opposite side which is the right side is referred to as the "wrist side" in FIG. 2 and FIG. 3 (the same applies to FIG. 6). In addition, the wrist front side is referred to as the "front side" and the opposite side which is the back side is referred to as the "rear side" in FIG. 4.

As illustrated in FIG. 1, the finger joint driving device 1 of the embodiment is mounted on an index finger 101 of a hand 100. The hand 100 of the embodiment is a hand of a person, for example, who has trouble bending and stretching the finger due to an accident or illness, who has a weak grip, or who has weakened force because of age. The index finger 101 includes a knuckle 102, a proximal interphalangeal joint 107, a middle phalanx 103, a distal interphalangeal joint 109, and a distal phalanx 104, and is configured in order from the knuckle 102 of the wrist side to the distal phalanx 104 of the end side of the finger.

The finger joint driving device 1 allows the finger joint of the index finger 101 to bend and stretch in a state where the finger joint driving device 1 is mounted on the hand 100 (the mounted state). That is, the finger joint driving device 1 is a device which is used to assist turning of the finger joint.

The finger joint driving device 1 is provided with a first base portion (a first member) 2, a first link portion (a second member) 3, a second link portion (a third member) 4, and a second base portion (a fourth member) 5, and these members are connected to each other in order from the wrist side toward the end side of the finger. Hereinafter, the configuration of the respective portions will be described.

As illustrated in FIG. 1 to FIG. 3, the first base portion 2 is disposed on the back of the hand 105 side of the knuckle 102 of the index finger 101 in the mounted state, that is, on the upper side in the drawings.

The first base portion 2 is a member of which an external shape is a flat block shape, and includes a surface 21 and a side surface 22.

The surface 21 which comes into contact with the knuckle 102 of the first base portion 2 is preferably bent along the shape of the knuckle 102. Accordingly, the first base portion 2 is disposed on the knuckle 102 without giving a sense of discomfort to a user (a wearer) of the finger joint driving device 1. Further, the first base portion 2 is stably disposed with respect to the knuckle 102.

In addition, the first base portion 2 is mounted on the knuckle 102 of the index finger 101 by using a mounting band 20A. The mounting band 20A is configured of a length adjustable belt and end portions 20T at both ends are respectively fixed to the two side surfaces 22 along the first base portion 2 in the extending direction. The mounting band 20A can allow the first base portion 2 to be adhered to the knuckle 102 by going around a palm of the hand 106 side of the knuckle 102 of the index finger 101. Therefore, it is possible to prevent the first base portion 2 from being separated from the knuckle 102.

As illustrated in FIG. 1 (the same is applied to FIG. 2 and FIG. 3), the second base portion 5 is disposed on the end side of the finger from the first base portion 2 in the mounted state, that is, disposed on the back of the hand 105 side of the middle phalanx 103 of the index finger 101. Accordingly, as will be described later, it is possible to bend and stretch the proximal interphalangeal joint (the second joint) 107 between the knuckle 102 and the middle phalanx 103 of the index finger 101 by using the finger joint driving device 1 (refer to FIG. 2 and FIG. 3).

The second base portion 5 is a member of which an external shape is a flat block shape and includes a projection portion which projects from the upper surface of both end portions in the extending direction and of which the cross section is formed into a concave shape. The second base portion 5 includes a surface 51, a side surface 52, and a rail portion 53.

The surface 51 which comes into contact with the middle phalanx 103 of the second base portion 5 is preferably bent along the shape of the middle phalanx 103. Accordingly, the second base portion 5 is disposed on the middle phalanx 103 without giving a sense of discomfort to the user of the finger joint driving device 1. Further, the second base portion 5 is stably disposed with respect to the middle phalanx 103.

In addition, the second base portion 5 is mounted on the middle phalanx 103 of the index finger 101 by using a mounting band 20B. The mounting band 20B is configured of a length adjustable belt similar to the mounting band 20A and the end portions 20T at both ends are respectively fixed to the two side surfaces 52 along the second base portion 5 in the extending direction. The mounting band 20B can allow the second base portion 5 to be adhered to the middle phalanx 103 by going around a palm of the hand 106 side of the middle phalanx 103 of the index finger 101. Therefore, it is possible to prevent the second base portion 5 from being separated from the middle phalanx 103.

The rail portion 53 is a pair of rails which are provided along the extending direction of the second base portion 5. The rail portion 53 is provided such that both ends are fixed to the concave-shaped projection portion of the second base portion 5, and the rest of both ends is positioned to be separated from a bottom surface of the concave shape.

As illustrated in FIG. 1, the first link portion 3 is provided on the end side of the finger of the first base portion 2, and a portion thereof is provided at a position overlapping with the upper surface of the second base portion 5. The first link portion 3 is a member of which the total length is greater than the total length of the first base portion 2 or the second base portion 5.

The first link portion 3 includes a top plate 31 and side walls 32 which project from both edge portions along the extending direction of the top plate 31 toward the direction opposite to the index finger 101. In addition, the two side walls 32 interpose a portion of the side surface 22 of the first base portion 2 therebetween.

In addition, each of the side walls 32 and the side surface 22 of the first base portion 2 are connected to each other via a turning support portion 11. The turning support portion 11 is configured to have an axis which is provided on one of the side wall 32 and the side surface 22 and a bearing which has the axis inserted therein and is provided on the other of the side wall 32 and the side surface 22. In addition, when a turning axis $O_{107}$ is assumed when the proximal interphalangeal joint 107 is turned by bending and stretching, a turning axis $O_{11}$ of the turning support portion 11 is in parallel with the turning axis $O_{107}$. With such a configuration, the first link portion 3 can be turned around the turning axis $O_{11}$ with respect to the first base portion 2 by the turning support portion 11.

The second link portion 4 is provided on the end side of the finger of the first link portion 3 and is provided to be positioned in the concave shape on the upper surface of the second base portion 5. The second link portion 4 includes a sliding portion 41 sliding with respect to the second base portion 5 and a projection portion 42 which projects from a portion of the upper surface on the sliding portion 41 toward a perpendicular direction of the upper surface.

As illustrated in FIG. 2 and FIG. 3, the sliding portion 41 is formed into a rectangular external shape, and includes a cylindrical hollow portion 411. The rail portion 53 of the second base portion 5 is inserted into the hollow portion 411 of the sliding portion 41.

Meanwhile, the total length of the rail portion 53 is sufficiently longer than the total length of the sliding portion 41, for example, it is preferably 1.5 times to 3 times the total length of the sliding portion 41, and more preferably 1.7 times to 2.3 times.

Since the sliding portion 41 slides while being guided by the rail portion 53, the second base portion 5 can relatively approach with respect to and be separated from the first base portion 2. FIG. 2 illustrates a state where the second base portion 5 approaches with respect to the first base portion 2 and FIG. 3 illustrates a state where the second base portion 5 is separated from the first base portion 2.

The projection portion 42 is interposed between the two side walls 32 of the first link portion 3. Then, the projection portion 42 and each of the side walls 32 are connected to each other via a turning support portion 12. The turning support portion 12 is configured to have an axis which is provided on one of the projection portion 42 and the side wall 32 and a bearing which has the axis inserted therein and is provided on the other of the projection portion 42 and the side wall 32. In addition, a turning axis $O_{12}$ of the turning support portion 12 is in parallel with the turning axis $O_{107}$.

With such a configuration, similar to the first link portion 3, the second link portion 4 can be turned around the turning axis $O_{12}$ which is in parallel with the turning axis $O_{107}$ by the turning support portion 12. Since the turning axis $O_{11}$ and the turning axis $O_{12}$ are in parallel with the turning axis $O_{107}$, it is possible to easily bend and stretch the proximal interphalangeal joint 107 by the finger joint driving device 1 while preventing unnecessary force from being applied to the proximal interphalangeal joint 107.

Configuration materials of the first base portion 2, the first link portion 3, the second link portion 4, and the second base portion 5 are not particularly limited and, for example, various kinds of resin materials such as polyethylene or various kinds of metallic materials such as aluminum can be used. In addition, configuration materials of the mounting bands 20A and 20B are not particularly limited; for example, various rubber materials such as silicone rubber can be used.

In addition, as illustrated in FIG. 1, the finger joint driving device 1 is further provided with the driving unit (the first driving unit) 6A and a control unit 10 in the vicinity of the turning support portion 11.

The driving unit 6A is a mechanical portion which functions for driving the first link portion 3 to be turned via the turning support portion 11.

As illustrated in FIG. 4, the driving unit 6A includes a first rotor 61 which is concentrically connected to the axis of the turning support portion 11, a second rotor 62 which causes the first rotor 61 to rotate, a third rotor which causes the second rotor 62 to rotate, and a piezoelectric motor 64 which causes the third rotor 63 to rotate.

The first rotor 61 is formed into a disk shape and is a gear including a tooth 611 at the external edge portion thereof.

The second rotor 62 includes a small gear 621 and a large gear 622. The small gear 621 includes a tooth 621*a* which is engaged with the tooth 611 of the first rotor 61. The large gear 622 is a gear of which a diameter of a base circle is larger than a diameter of a base circle of the small gear 621. The large gear 622 is concentrically disposed with the small gear 621, and is connected (fixed) to the rear side of the small gear 621.

The third rotor 63 includes a small gear 631 and a large disk portion 632. The small gear 631 includes a tooth 631*a* which is engaged with a tooth 622*a* of the large gear 622. The large disk portion 632 is formed into a disk shape, and the diameter thereof is larger than the diameter of the base circle of the small gear 631. The large disk portion 632 is concentrically disposed with the small gear 631, and is connected to the front side of the small gear 631.

The piezoelectric motor 64 includes a piezoelectric material exerting a piezoelectric effect, and is a stacked body which is configured to have two sheet-like piezoelectric elements 65 and a shim plate 66 which is formed of a metal flat plate and interposed between the piezoelectric elements 65 and bonded thereto. Hereinafter, the lateral direction of the piezoelectric motor 64 is referred to as an "x direction", the width direction of the piezoelectric motor 64 which is orthogonal to the x direction is referred to as a "y direction", and the thickness direction of the piezoelectric motor 64 which is orthogonal to the x direction and the y direction is referred to as a "z direction".

Each of the piezoelectric elements 65 is provided with four electrodes 651 so as to apply the voltage to the piezoelectric element 65. These electrodes 651 are disposed in a matrix state of two lines and two rows on the piezoelectric element 65, and as a power supply source, batteries (not shown) such as button batteries are electrically connected to each other.

In addition, the shim plate 66 which is made of metal not only reinforces the piezoelectric element 65 but also serves as a common electrode for applying the voltage to the piezoelectric element 65, and is grounded.

An end portion of the piezoelectric motor 64 in the +x direction is provided with a convex portion 67. The convex portion 67 is integrally formed with the shim plate 66.

Four supporting portions 68, which support the piezoelectric motor 64 in a state of biasing toward the side on which the convex portion 67 is provided, are provided on both side surfaces of the piezoelectric motor 64 which face the ±y direction. These supporting portions 68 are integrally formed with the shim plate 66 and disposed on four corners of the shim plate 66 which is formed into a rectangular shape. Meanwhile, it is preferable that the supporting portions 68 which are adjacent in the x direction are connected to each other via a connection plate 69.

The operating principles of the piezoelectric motor 64 in such a configuration will be described with reference to FIGS. 5A to 5C.

The piezoelectric motor 64 is operated by an elliptical motion of the convex portion 67 of the piezoelectric motor 64 when the electrodes 651 of the respective piezoelectric elements 65 are periodically applied with the voltage. The convex portion 67 of the piezoelectric motor 64 performs the elliptical motion due to the following reason. Note that the electrodes 651 which are provided in the piezoelectric elements 65 are the same except for the disposition place, and thus the front side of the electrode 651 of the piezoelectric element 65 will be representatively described.

As is well known, the piezoelectric element 65 including the piezoelectric material has a property of extension when a positive voltage is applied to the piezoelectric element 65. Accordingly, as illustrated in FIG. 5A, when the positive voltage is applied to all of the four electrodes 651, and then the applied voltage is repeatedly canceled at a particular frequency, the piezoelectric motor (the piezoelectric element 65) can generate a kind of resonance phenomenon in which the piezoelectric motor extends and contracts in the x direction. Meanwhile, an operation in which the piezoelectric motor 64 repeatedly extends and contracts in the x direction is referred to as an "extension and contraction vibration", and the direction in which the piezoelectric motor 64 extends and contracts (the ±x direction in the drawings) is referred to as an "extension and contraction direction".

In addition, as illustrated in FIG. 5B or FIG. 5C, when two electrodes 651 which are positioned by each other on a diagonal line (a pair of an electrode 651*a* and an electrode 651*d* or a pair of an electrode 651*b* and an electrode 651*c*) are assumed to be a pair and the voltage at a particular frequency is applied to the two electrodes 651, the piezoelectric motor (the piezoelectric element 65) can generate a kind of resonance phenomenon in which the tip end portion (a portion with which the convex portion 67 is provided) in the x direction moves in the vertical direction (the y direction) in the drawing.

For example, as illustrated in FIG. 5B, when the positive voltage is periodically applied to the pair of the electrode 651*a* and the electrode 651*d*, the piezoelectric motor 64 repeatedly operates the tip end portion in the x direction to move in the vertical direction. In addition, as illustrated in FIG. 5C, when the positive voltage is periodically applied to the pair of the electrode 651*b* and the electrode 651*c*, the piezoelectric motor 64 repeatedly operates the tip end portion in the x direction to move in the vertical direction. Such an operation of the piezoelectric motor 64 is referred to as a "bending vibration". Hereinafter, the direction (the ±y direction) in which the piezoelectric motor 64 performs the bending vibration is referred to as a "bending direction".

In addition, it is possible to concurrently derive a resonance of the "extension and contraction vibration" with a resonance of the "bending vibration" by appropriately selecting physical properties of the piezoelectric element 65 and dimensions of the piezoelectric element 65 (full length, width, and thickness). As a result, in a case where the voltage is applied to the pair of the electrode 651*a* and the electrode 651*d* in a state illustrated in FIG. 5B, the tip end portion (a portion with which the convex portion 67 is provided) of the piezoelectric motor 64 performs an operation (the elliptical motion) of turning clockwise as if drawing an ellipse in the drawing. In addition, in a case where the voltage is applied to the pair of the electrode 651*b* and the electrode 651*c* in a state illustrated in FIG. 5C, the tip end portion of the piezoelectric motor 64 performs the elliptical motion of turning counterclockwise in the drawing. The piezoelectric element 65 of the rear side has exactly the same configuration as that of the piezoelectric motor 64 of the front side.

The piezoelectric motor 64 drives the first link portion 3 which is a driven body by using such an elliptical motion.

That is, the elliptical motion is generated in a state in which the convex portion 67 of the piezoelectric motor 64 is pressed to an external edge portion 632*a* of the large disk portion 632 of the third rotor 63. Accordingly, the convex portion 67 moves from the left to the right (or from the right to the left) in a state of being pressed to the driven body when the piezoelectric motor 64 extends; on the other hand, the convex portion 67 returns back to the previous position in a state of being separated from the driven body when the piezoelectric motor 64 contracts, and the convex portion 67 repeats the above operations. As a result, the third rotor 63 rotates in one direction due to the friction force received from the convex portion 67. Then, such a rotating force is transferred via the small gear 631 of the third rotor 63, the large gear 622 of the second rotor, the small gear 621, and the first rotor 61 in order. Accordingly, it is possible to drive the first link portion 3 to be turned via the turning support portion 11.

In the finger joint driving device 1, it is possible to reliably drive the first link portion 3 to be turned with a simple configuration by using the piezoelectric element 65. In addition, the configuration using the piezoelectric element 65 contributes to miniaturization and thickness reduction of the finger joint driving device 1.

In addition, the piezoelectric motor 64 is preferable because the piezoelectric motor 64 gets a higher resolution as the proximal interphalangeal joint 107 of the index finger 101 further bends to grasp.

Meanwhile, the driving unit 6A functions for driving the first link portion 3 to be turned in the embodiment, but may function for driving the second link portion 4 to be turned. Similarly, in this case, it is possible to reliably drive the second link portion 4 to be turned and to contribute to miniaturization and thickness reduction of the finger joint driving device 1.

The control unit 10 controls the operation of the driving unit 6A based on a program which is recorded in advance. The control unit 10 is, for example, built into the second link portion 4 together with a battery (not shown) such as a button battery which supplies electric power to the driving unit 6A. Meanwhile, the configuration of the control unit 10 is not particularly limited. For example, it is possible to employ a configuration including a microprocessor and a memory.

Next, the operation of the finger joint driving device 1 will be described.

In the state illustrated in FIG. 2, in the finger joint driving device 1, the first base portion 2 is mounted on the knuckle 102 of the index finger 101 and the second base portion 5 is mounted on the middle phalanx 103. Then, when the driving unit 6A is operated in this state as described above, as illustrated in FIG. 3, it is possible to turn the second link portion 4 in the counterclockwise direction in the drawing. Therefore, the middle phalanx 103 of the index finger 101 is pressed together with the second base portion 5 on the obliquely right downward side in FIG. 3. As a result, the proximal interphalangeal joint 107 of the index finger 101 is bent.

In addition, if the second link portion 4 is turned in the direction opposite to the turning direction from the state illustrated in FIG. 3, in other words, the second link portion 4 is turned clockwise in the drawing, as illustrated in FIG. 2, the middle phalanx 103 of the index finger 101 is pulled together with the second base portion 5 on the obliquely left upward side in the drawings. As a result, the proximal interphalangeal joint 107 of the index finger 101 extends.

Further, if the proximal interphalangeal joint 107 is bent (or extends), the second base portion 5 is separated (or approaches with respect to) from the first base portion 2. However, as described above, since the second link portion 4 and the second base portion 5 are relatively movable, the second base portion 5 is quickly and smoothly separated (or approaches with respect to) from the first base portion 2. Accordingly, it is possible to easily bend the proximal interphalangeal joint 107, thereby reducing a burden to the index finger 101.

In addition, the user of the finger joint driving device 1 can bend and stretch the distal interphalangeal joint 109 of the index finger 101, a thumb, a middle finger, a ring finger, and a little finger which are not assisted by the finger joint driving device 1 separately from the proximal interphalangeal joint 107 of the index finger 101.

Further, for example, the finger joint driving device 1 can suppress the thickness of the entire device compared with a configuration in which the member which is disposed on the back of the hand 105 slides and thus the finger joint is allowed to bend and stretch (for example, refer to JP-A-2002-345861). Accordingly, when the user uses the finger joint driving device 1 mounted on the hand, it is possible to reduce the limitation of the movement of a user's hand.

In addition, since the second link portion 4 and the second base portion 5 are relatively movable in the middle phalanx 103 of the index finger 101 side, it is possible to mount the finger joint driving device 1 without depending on the length of the index finger 101, thereby realizing high versatility.

Meanwhile, in the finger joint driving device 1 in the mounted state, the first base portion 2 is disposed on the knuckle 102 of the index finger 101 and the second base portion 5 is disposed on the middle phalanx 103 in the embodiment; however, such a disposition is not limited.

For example, in the mounted state, the first base portion 2 may be disposed on the back of the hand 105 and the second base portion 5 may be disposed on the knuckle 102 of the index finger 101. In this case, it is possible to bend and stretch the metacarpophalangeal joint (the third joint) 108 by the finger joint driving device 1.

Additionally, in the mounted state, the first base portion 2 may be disposed on the middle phalanx 103 of the index finger 101 and the second base portion 5 may be disposed on the distal phalanx 104. In this case, it is possible to bend and stretch the distal interphalangeal joint (the first joint) 109 by the finger joint driving device 1.

In addition, in the mounted state, the first base portion 2 may be disposed on the middle phalanx 103 of the index finger 101 and the second base portion 5 may be disposed on the knuckle 102 of the wrist side from the first base portion 2. In this case, similar to the mounted state in the embodiment, it is possible to bend and stretch the proximal interphalangeal joint 107 by the finger joint driving device 1.

As described above, it is possible to preferentially assist the finger joint to be bent and stretched, and therefore, it is possible to flexibly perform various assist operations with response to the usage state.

Further, the mounting position of the finger joint driving device 1 with respect to the hand 100 is the index finger 101 in the embodiment; however, the mounting position is not limited. For example, the thumb, the middle finger, the ring finger, or the little finger may be used as the mounting position.

Second Embodiment

Figure 6:
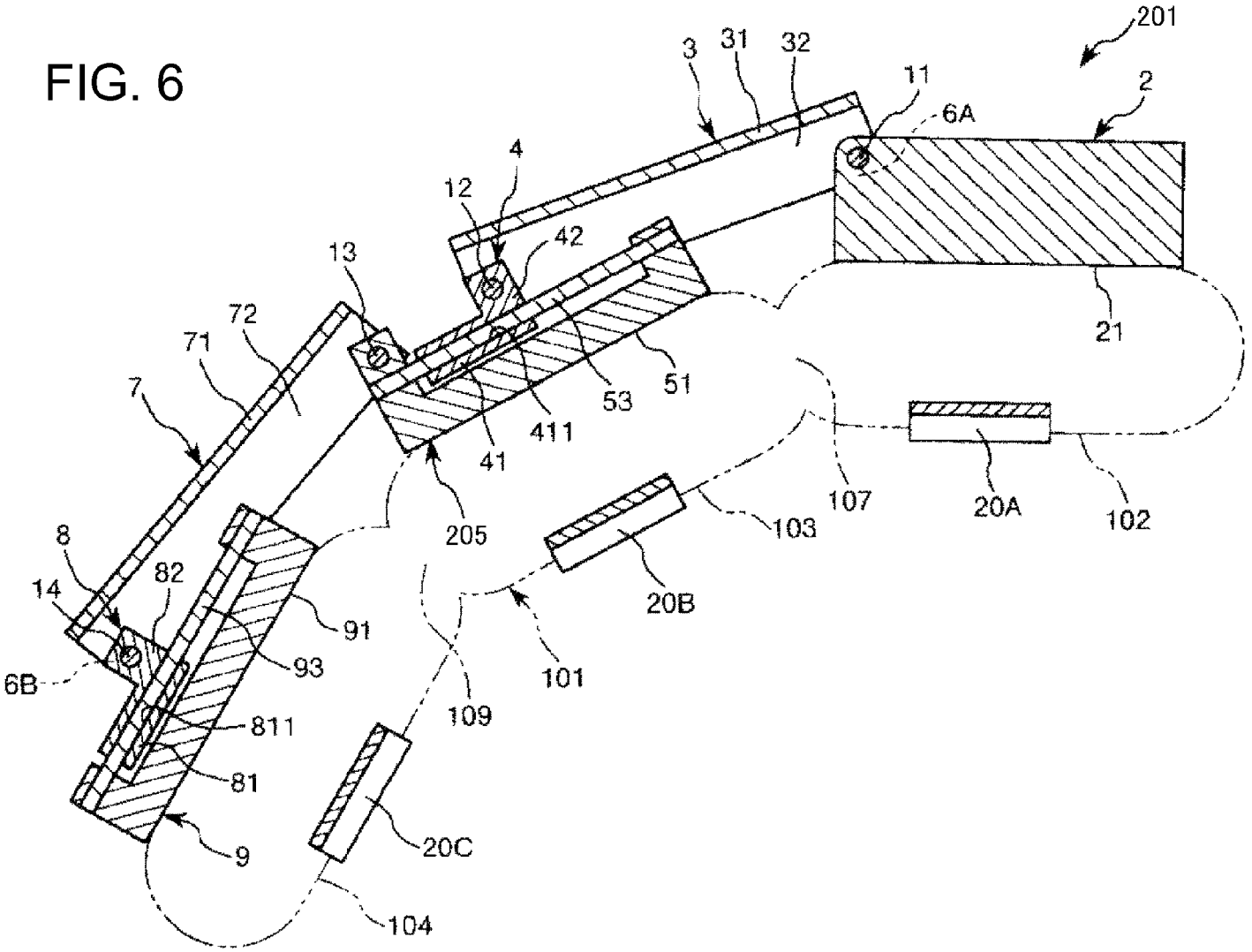
FIG. 6 is a cross-sectional view illustrating a usage state of a finger joint driving device according to a second embodiment.

FIG. 6 is a cross-sectional view illustrating a usage state of a finger joint driving device according to a second embodiment.

Hereinafter, the finger joint driving device of the second embodiment will be described with reference to drawings, but the description will focus on the differences from the embodiments described above and the same matters will be omitted.

The finger joint driving device 201 according to the embodiment is configured to bend and stretch not only the proximal interphalangeal joint 107 but also the distal interphalangeal joint 109, and the end portion on the end side of the finger of the second base portion 205 is connected to the third link portion (the fifth member) 7, and thus is the same as the finger joint driving device 1 in the first embodiment other than a point that the thickness is large compared with the second base portion 5 in the first embodiment.

As illustrated in FIG. 6, the finger joint driving device 201 is provided with a third link portion (the fifth member) 7, a fourth link portion (the sixth member) 8, and a third base portion (the seventh member) 9 in addition to the first base portion 2, first link portion 3, and the second base portion 205, and these members are connected to each other in order from the wrist side to the end side of the finger.

The third base portion 9 is disposed on the end side of the finger from the second base portion 205 (the third link portion 7) in the mounted state, that is, disposed on the back of the hand 105 side of the distal phalanx 104 of the index finger 101. Accordingly, as will be described later, it is possible to bend and stretch the distal interphalangeal joint 109 between the middle phalanx 103 and the distal phalanx 104 of the index finger 101 by using the finger joint driving device 201.

The third base portion 9 is a member of which an external shape is a flat block shape similar to the second base portion 5 in the first embodiment. The third base portion 9 includes a surface 91 and a rail portion 93.

The surface 91 which comes into contact with the distal phalanx 104 of the third base portion 9 is preferably bent along the shape of the distal phalanx 104. Accordingly, the third base portion 9 is disposed on the distal phalanx 104 without giving a sense of discomfort to the user of the finger joint driving device 201. Further, the third base portion 9 is stably disposed with respect to the distal phalanx 104.

In addition, the third base portion 9 is mounted on the distal phalanx 104 of the index finger 101 by using a mounting band 20C. The mounting band 20C is configured of a length adjustable belt similar to the mounting band 20A and both end portions are respectively fixed to the two side surfaces along the third base portion 9 in the extending direction. The mounting band 20C can allow the third base portion 9 to be adhered to the distal phalanx 104 by going around a palm of the hand 106 side of the distal phalanx 104 of the index finger 101. Therefore, it is possible to prevent the third base portion 9 from being separated from the distal phalanx 104.

Since the rail portion 93 has the same structure as that of the rail portion 53 in the first embodiment, the description thereof will be omitted.

The third link portion 7 is provided on the end side of the finger of the second base portion 205, and a portion thereof is provided at the position overlapping with the upper surface of the third base portion 9. The third link portion 7 is a member of which the total length is the same as the total length of the first link portion 3.

The third link portion 7 includes a top plate 71 and side walls 72 which project from both edge portions along the extending direction of the top plate 71 toward the direction opposite to the index finger 101. In addition, the two side walls 72 interpose a portion of the side surface provided on the end portion of the end side of the finger of the second base portion 205 therebetween.

In addition, each of the side walls 72 and the side surface of the second base portion 205 are connected to each other via a turning support portion 13. The turning support portion 13 is configured to have an axis which is provided on one of the side wall 72 and the second base portion 205 and a bearing which has the axis inserted therein and is provided on the other of the side wall 72 and the second base portion 205. In addition, when a turning axis is assumed when the distal interphalangeal joint 109 is turned by bending and stretching, a turning axis of the turning support portion 13 is in parallel with the turning axis of the distal interphalangeal joint 109. With such a configuration, the third link portion 7 can be turned around the turning axis of the turning support portion 13 with respect to the second base portion 205 by the turning support portion 13.

The fourth link portion 8 is provided on the end side of the finger of the third link portion 7 and is provided to be positioned in the concave shape on the upper surface of the third base portion 9. The fourth link portion 8 includes a sliding portion 81 sliding with respect to the third base portion 9 and a projection portion 82 which projects from a portion on the upper surface of the sliding portion 81 toward perpendicular direction of the upper surface.

Similar to the sliding portion 41 as illustrated in FIG. 2 and FIG. 3, the sliding portion 81 is formed into a rectangular external shape, and includes a cylindrical hollow portion 811. The rail portion 93 of the third base portion 9 is inserted into the hollow portion 811 of the sliding portion 81.

Meanwhile, the total length of the rail portion 93 is sufficiently longer than the total length of the sliding portion 81, for example, it is preferably 1.5 times to 3 times the total length of the sliding portion 81, and more preferably 1.5 times to 2 times.

Since the sliding portion 81 slides while being guided by the rail portion 93, the third base portion 9 can relatively approach with respect to and be separated from the second base portion 205.

The projection portion 82 is interposed between the two side walls 72 of the third link portion 7. Then, the projection portion 82 and each of the side walls 72 are connected to each other via a turning support portion 14. The turning support portion 14 is configured to have an axis which is provided on one of the projection portion 82 and the side wall 72 and a bearing which has the axis inserted therein and is provided on the other of the projection portion 82 and the side wall 72. In addition, a turning axis of the turning support portion 14 is in parallel with the turning axis of the distal interphalangeal joint 109.

With such a configuration, similar to the third link portion 7, the fourth link portion 8 can be turned around the turning axis of the turning support portion 14 which is in parallel with the turning axis of the distal interphalangeal joint 109 by the turning support portion 14.

Since the turning axis of the turning support portion 13 and the turning axis of the turning support portion 14 are in parallel with the turning axis of the distal interphalangeal joint 109, it is possible to easily bend and stretch the distal interphalangeal joint 109 by the finger joint driving device 201 while preventing unnecessary force from being applied to the distal interphalangeal joint 109.

Configuration materials of the third link portion 7, the fourth link portion 8, and the third base portion 9 are not particularly limited, for example, it is possible to use the same configuration materials as that of the first base portion 2. In addition, configuration materials of the mounting band 20C are not particularly limited, for example, it is possible to use the same configuration materials as that of the mounting band 20A.

In addition, as illustrated in FIG. 6, the finger joint driving device 201 is further provided with the driving unit (the second driving unit) 6B in the vicinity of the turning support portion 14.

The driving unit 6B is a mechanical portion which functions for driving the fourth link portion 8 to be turned via the turning support portion 14. In addition, the proximal interphalangeal joint 107 and the distal interphalangeal joint 109 of the index finger 101 are separated from each other or synchronized to each other by the driving unit 6A and the driving unit 6B, and thus can be reliably turned. Accordingly, since the number of the joint portions that assist the user increases, the hand of the operation becomes easier.

Meanwhile, similar to the configuration of the driving unit 6A, that is, the driving unit 6B is configured to include the first rotor 61, the second rotor 62, the third rotor 63, and the piezoelectric motor 64 which causes the third rotor 63 to rotate. Therefore, it is possible to use common components in the configuration components of the driving unit 6A and the driving unit 6B, and thus, it is possible to reduce the manufacturing cost of the finger joint driving device 201.

In addition, the driving unit 6B functions for driving the fourth link portion 8 (the turning support portion 14) to be turned in the embodiment, but may function for driving the third link portion 7 (the turning support portion 13) to be turned.

Third Embodiment

Figure 7:
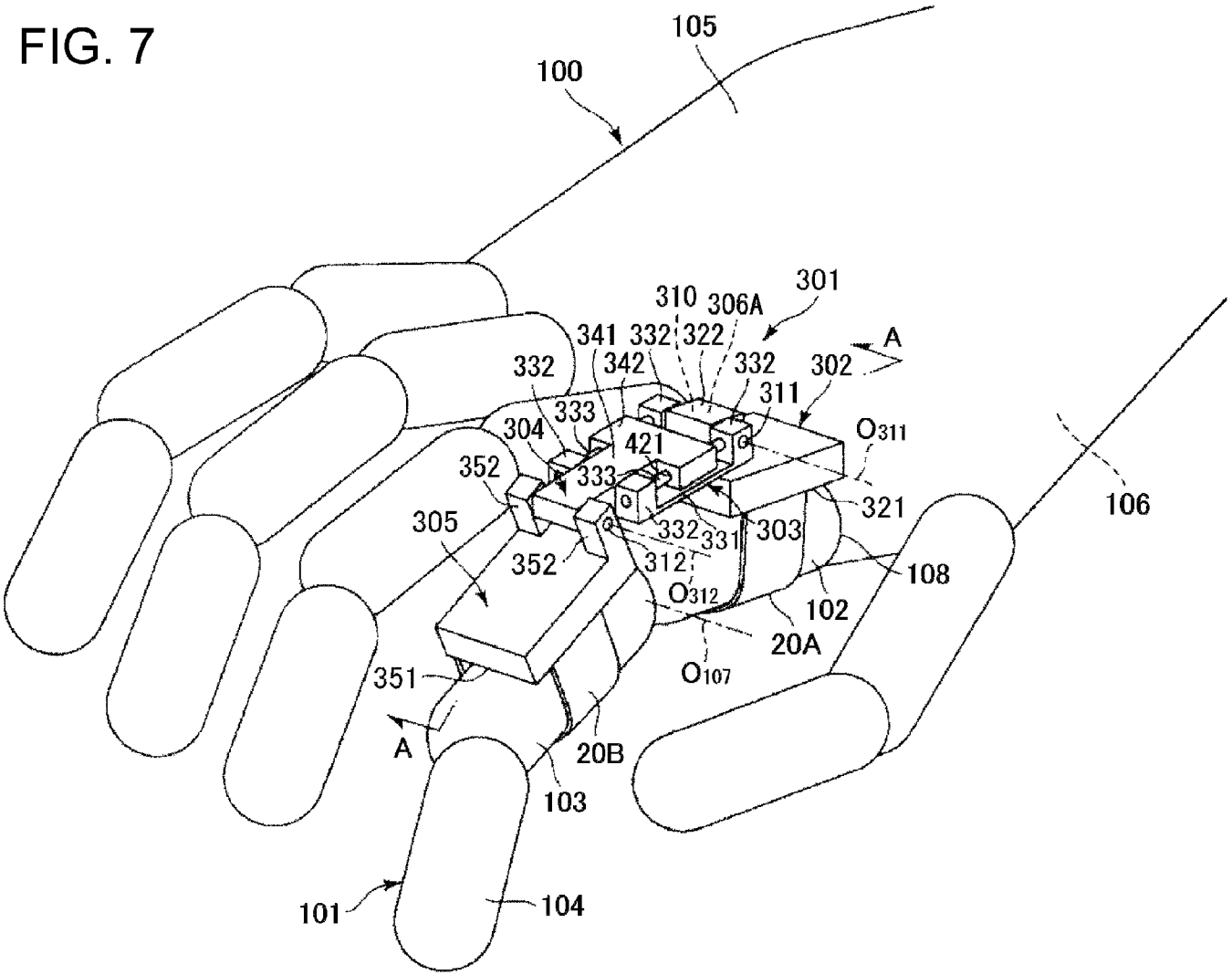
FIG. 7 is a perspective view illustrating a usage state of a finger joint driving device according to a third embodiment.
Figure 8:
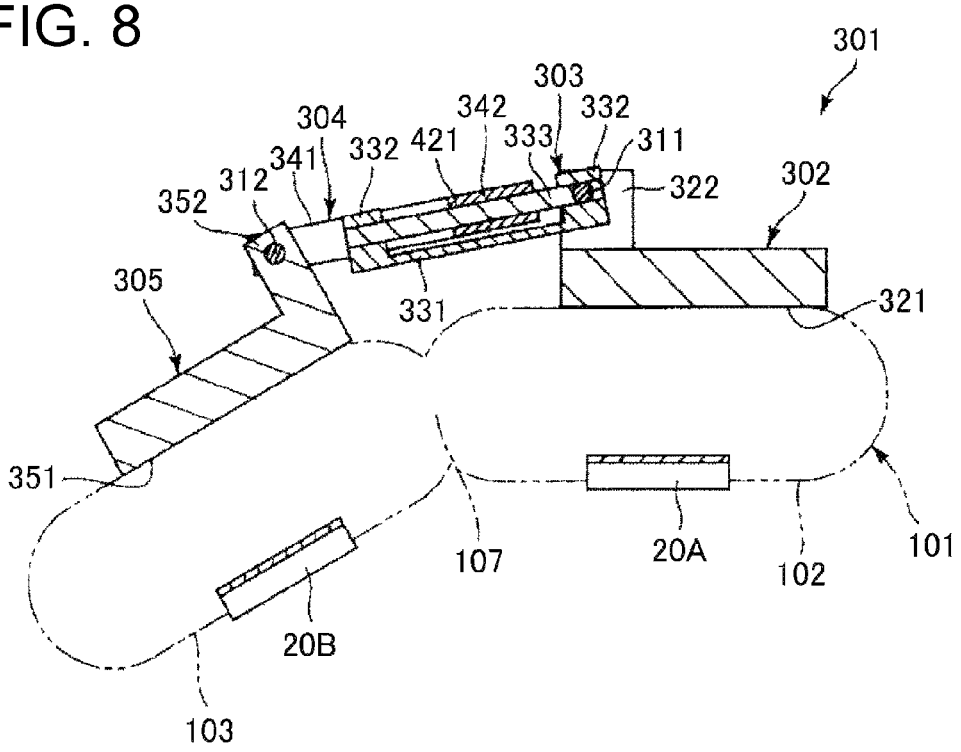
FIG. 8 is a cross-sectional view taken along line A-A in FIG. 7.
Figure 9:
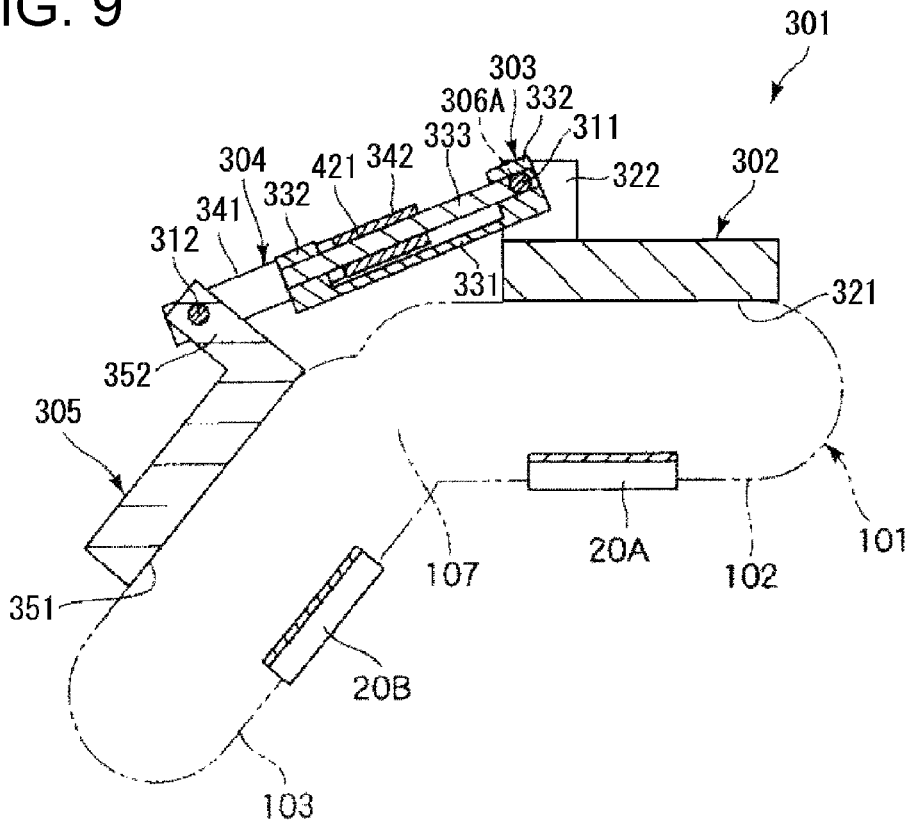
FIG. 9 is a cross-sectional view illustrating a finger which is bent in the state illustrated in FIG. 8.

FIG. 7 is a perspective view illustrating a usage state of a finger joint driving device according to a third embodiment of the invention. FIG. 8 is a cross-sectional view taken along line A-A in FIG. 7. FIG. 9 is a cross-sectional view illustrating a finger which is bent in the state illustrated in FIG. 8. Note that, hereinafter, for the sake of convenience of description, obliquely left downward side is referred to as the "end side of the finger" and the opposite side is referred to as the "wrist side" in FIG. 7, and the left side is referred to as the "end side of the finger" and the opposite side is referred to as the "wrist side" in FIG. 8 and FIG. 9 (the same is applied to FIG. 10).

Hereinafter, the finger joint driving device of the third embodiment will be described with reference to drawings, but the description will focus on the differences from the embodiments described above and the same matters will be omitted.

As illustrated in FIG. 7, a finger joint driving device 301 of the embodiment is mounted on an index finger 101 of a hand 100. The description of the hand 100 and the index finger 101 is the same as those of the above embodiments, and thus will be omitted.

The finger joint driving device 301 allows the finger joint of the index finger 101 to bend and stretch in a state where the finger joint driving device 301 is mounted on the hand 100 (the mounted state). That is, the finger joint driving device 301 is a device which is used to assist turning of the finger joint.

The finger joint driving device 301 is provided with a first base portion (the first member) 302, a first link portion (the second member) 303, a second link portion (the third member) 304, and a second base portion (the fourth member) 305, and these members are connected to each other in order from the wrist side toward the end side of the finger. Hereinafter, the configuration of the respective portions will be described.

As illustrated in FIG. 7 to FIG. 9, the first base portion 302 is disposed on the back of the hand 105 side of the knuckle 102 of the index finger 101 in the mounted state, that is, on the upper side in the drawings.

The first base portion 302 is a member of a flat block shape, and includes a surface 321 and a projection portion 322. The surface 321 which comes into contact with the knuckle 102 of the first base portion 302 is preferably bent along the shape of the knuckle 102. Accordingly, the first base portion 302 is disposed on the knuckle 102 without giving a sense of discomfort to a user (a wearer) of the finger joint driving device 301. Further, the first base portion 302 is stably disposed with respect to the knuckle 102.

In addition, the first base portion 302 is mounted on the knuckle 102 of the index finger 101 by using a mounting band 20A. Since the configuration of the mounting band 20A is the same as that in the first embodiment, the description will be omitted. The mounting band 20A can allow the first base portion 302 to be adhered to the knuckle 102 by going around a palm of the hand 106 side of the knuckle 102 of the index finger 101. Therefore, it is possible to prevent the first base portion 302 from being separated from the knuckle 102.

The projection portion 322 is formed into a rectangular shape projected to the direction perpendicular to the upper surface in the end portion of the end side of the finger on the upper surface of the first base portion 302 which forms a rectangular shape in a planar view. Meanwhile, the projection portion 322, of which the width along the short side direction of the upper surface is smaller than the width of the first base portion 302, is formed in the vicinity of the center in the width direction.

The second base portion 305 is disposed on the end side of the finger from the first base portion 302 in the mounted state, that is, disposed on the back of the hand 105 side of the middle phalanx 103 of the index finger 101. Accordingly, as will be described later, it is possible to bend and stretch the proximal interphalangeal joint (the second joint) 107 between the knuckle 102 and the middle phalanx 103 of the index finger 101 by using the finger joint driving device 301 (refer to FIG. 8 and FIG. 9).

The second base portion 305 is a member which is formed into a flat block shape and includes a surface 351 and a pair of the convex portions 352. The surface 351 which comes into contact with the middle phalanx 103 of the second base portion 305 is preferably bent along the shape of the middle phalanx 103. Accordingly, the second base portion 305 is disposed on the middle phalanx 103 without giving a sense of discomfort to the user of the finger joint driving device 301. Further, the second base portion 305 is stably disposed with respect to the middle phalanx 103.

In addition, the second base portion 305 is mounted on the middle phalanx 103 of the index finger 101 by using a mounting band 20B. Since the configuration of the mounting band 20B is the same as that in the first embodiment, the description will be omitted. The mounting band 20B can allow the second base portion 305 to be adhered to the middle phalanx 103 by going around a palm of the hand 106 side of the middle phalanx 103 of the index finger 101. Therefore, it is possible to prevent the second base portion 305 from being separated from the middle phalanx 103.

The convex portions 352 which are formed into a rectangular shape in a planar view are projected from two corners of the wrist side and separated from each other.

As illustrated in FIG. 7, the first link portion 303 is provided on the end side of the finger of the first base portion 302. The first link portion 303 includes a bottom plate 331 which is formed into a rectangular shape in a planar view and projections 332 which are projected from four corners of the bottom plate 331.

In addition, the projection portion 322 of the first base portion 302 is interposed between two projections 332 on the first base portion 302 side (the wrist side).

Further, in the first link portion 303, two projections 332 on the first base portion 302 side and the projection portion 322 on the first base portion 302 are connected to each other via a turning support portion 311. The turning support portion 311 is configured to have an axis which is provided on one of a pair of the projections 332 and the first base portion 302 (the projection portion 322) of the back of the hand 105 side and a bearing which has the axis inserted therein and is provided on the other of a pair of the projections 332 and the first base portion 302.

In addition, when a turning axis $O_{107}$ is assumed when the proximal interphalangeal joint 107 is turned by bending and stretching, a turning axis $O_{311}$ of the turning support portion 311 is in parallel with the turning axis $O_{107}$. With such a configuration, the first link portion 303 can be turned around the turning axis $O_{311}$ with respect to the first base portion 302 by the turning support portion 311.

In addition, each of rail portions 333 is installed between two projections 332 which are positioned on the thumb side in the mounted state and between two projections 332 which are positioned on the middle finger in the mounted state.

A second link portion 304 is provided on the end side of the finger of the first link portion 303 and a portion thereof is provided at a position overlapping with the upper surface of the first link portion 303. The second link portion 304 is a member of turning with respect to the second base portion 305.

In addition, the second link portion 304 includes a linear long length portion 341 and a pair of the projection portions 342 which are projected from the long length portion 341, and is formed of a plate piece of which an external shape is substantially a T shape. Specifically, a pair of the projection portions 342 are projected in the direction intersecting with the lateral direction of the long length portion 341 from the end portion of the first base portion 302 side of the long length portion 341, and projected toward the opposite sides.

In addition, each of the projection portions 342 includes a hollow portion 421 which is penetrated in a cylindrical shape and a pair of rail portions 333 of the first link portion 303 are respectively inserted into each of the hollow portions 421.

Since the projection portion 342 slides while being guided by the rail portion 333, the second link portion 304 can relatively approach with respect to and be separated from the first base portion 302. FIG. 8 illustrates a state where the second link portion 304 approaches with respect to the first base portion 302 and FIG. 9 illustrates a state where the second link portion 304 is separated from the first base portion 302.

Meanwhile, the total length of the rail portion 333 is sufficiently longer than the total length of the projection portion 342 (the hollow portion 421), for example, it is preferably 1.5 times to 3 times the total length of the projection portion 342, and more preferably 1.7 times to 2.3 times.

The tip end portion of the long length portion 341 is interposed between a pair of the convex portions 352 of the second base portion 305. Then, the end portion of the end side of the finger of the long length portion 341 and each of the convex portions 352 are connected to each other via a turning support portion 312. The turning support portion 312 is configured to have an axis which is provided on one of the end portion of the end side of the finger of the long length portion 341 and each of the convex portions 352 and a bearing which has the axis inserted therein and is provided on the other of the end portion of the end side of the finger of the long length portion 341 and each of the convex portions 352.

In addition, a turning axis $O_{312}$ of the turning support portion 312 is in parallel with the turning axis $O_{107}$. With such a configuration, similar to the first link portion 303, the second base portion 305 can be turned around the turning axis $O_{312}$ which is in parallel with the turning axis $O_{107}$ by the turning support portion 312. Since the turning axis $O_{311}$ and the turning axis $O_{312}$ are in parallel with the turning axis $O_{107}$, it is possible to easily bend and stretch the proximal interphalangeal joint 107 by the finger joint driving device 301 while preventing unnecessary force from being applied to the proximal interphalangeal joint 107.

Configuration materials of the first base portion 302, the first link portion 303, the second link portion 304, and the second base portion 305 are not particularly limited, for example, various kinds of resin materials such as polyethylene or various kinds of metallic materials such as aluminum can be used. In addition, configuration materials of the mounting bands 20A and 20B are not particularly limited, for example, various rubber materials such as silicone rubber can be used.

In addition, as illustrated in FIG. 7, the finger joint driving device 301 is further provided with the driving unit (the first driving unit) 306A and a control unit 310 in the vicinity of the projection portion 322.

The driving unit 306A is a mechanical portion which functions for driving the first link portion 303 to be turned via the turning support portion 311.

Since the driving unit 306A has the same structure as that of the driving unit 6A illustrated in FIG. 4 and FIGS. 5A and 5C of the first embodiment, the explanation thereof will be omitted.

The piezoelectric motor 64 drives the first link portion 303 which is a driven body by using such an elliptical motion as illustrated in FIGS. 5A to 5C.

Accordingly, it is possible to drive the second base portion 305 to be turned via the turning support portion 311.

In the finger joint driving device 301, it is possible to reliably drive the first link portion 303 to be turned with a simple configuration by using the piezoelectric element 65. In addition, the configuration using the piezoelectric element 65 contributes to miniaturization and thickness reduction of the finger joint driving device 301.

In addition, the piezoelectric motor 64 is preferable because the piezoelectric motor 64 gets a higher resolution as the proximal interphalangeal joint 107 of the index finger 101 further stretches.

Meanwhile, the driving unit 306A functions for driving the first link portion 303 to be turned in the embodiment, but may function for driving the second base portion 305 to be turned. Similarly, in this case, it is possible to reliably drive the second base portion 305 to be turned and to contribute to miniaturization and thickness reduction of the finger joint driving device 301.

The control unit 310 controls the operation of the driving unit 306A based on a program which is recorded in advance. The control unit 310 is, for example, built into the second link portion 304 together with a battery (not shown) such as a button battery which supplies electric power to the driving unit 306A. Meanwhile, the configuration of the control unit 310 is not particularly limited. For example, it is possible to employ a configuration including a microprocessor and a memory.

Next, the operation of the finger joint driving device 301 will be described.

In the state illustrated in FIG. 8, in the finger joint driving device 301, the first base portion 302 is mounted on the knuckle 102 of the index finger 101 and the second base portion 305 is mounted on the middle phalanx 103. Then, when the driving unit 306A is operated from this state so as to be described above, as illustrated in FIG. 9, it is possible to turn the second link portion 304 in the counterclockwise direction in the drawing. Therefore, the middle phalanx 103 of the index finger 101 is pressed together with the second base portion 305 on the obliquely right downward side in FIG. 9. As a result, the proximal interphalangeal joint 107 of the index finger 101 is bent.

In addition, if the first link portion 303 is turned in the direction opposite to the turning direction from the state illustrated in FIG. 9, in other words, the first link portion 303 is turned clockwise in the drawing, as illustrated in FIG. 8, the middle phalanx 103 of the index finger 101 is pulled on the obliquely left upward side in the drawings. As a result, the proximal interphalangeal joint 107 of the index finger 101 extends.

Further, if the proximal interphalangeal joint 107 is bent (or extends), the second base portion 305 is separated (or approaches with respect to) from the first base portion 302. However, as described above, since the first link portion 303 and the second link portion 304 are relatively movable, the second base portion 305 is quickly and smoothly separated (or approaches with respect to) from the first base portion 302. Accordingly, it is possible to easily bend the proximal interphalangeal joint 107, thereby reducing a burden to the index finger 101.

In addition, the user of the finger joint driving device 301 can bend and stretch the distal interphalangeal joint 109 of the index finger 101, a thumb, a middle finger, a ring finger, and a little finger which are not assisted by the finger joint driving device 301 separately from the proximal interphalangeal joint 107 of the index finger 101.

Further, for example, the finger joint driving device 301 can suppress the thickness of the entire device compared with a configuration in which, the member which is disposed on the back of the hand 105 slides and thus the finger joint is allowed to bend and stretch (for example, refer to JP-A-2002-345861). Accordingly, when the user uses the finger joint driving device 301 mounted on the hand, it is possible to reduce the limitation of the movement of a user's hand.

In addition, since the first link portion 303 and the second link portion 304 between the knuckle 102 and the middle phalanx 103 of the index finger 101 are relatively movable, it is possible to mount the finger joint driving device 301 without depending on the length of the index finger 101, thereby realizing high versatility.

Meanwhile, in the finger joint driving device 301 in the mounted state, the first base portion 302 is disposed on the knuckle 102 of the index finger 101 and the second base portion 305 is disposed on the middle phalanx 103 in the embodiment; however, such a disposition is not limited. For example, in the mounted state, the first base portion 302 may be disposed on the back of the hand 105 and the second base portion 305 may be disposed on the knuckle 102 of the index finger 101. In this case, it is possible to bend and stretch the metacarpophalangeal joint (the third joint) 108 by the finger joint driving device 301. Additionally, in the mounted state, the first base portion 302 may be disposed on the middle phalanx 103 of the index finger 101 and the second base portion 305 may be disposed on the distal phalanx 104. In this case, it is possible to bend and stretch the distal interphalangeal joint (the first joint) 109 by the finger joint driving device 301.

As described above, it is possible to preferentially assist the finger joint to be bent and stretched, and therefore, it is possible to flexibly perform various assist operations with response to the usage state.

Further, the mounting position of the finger joint driving device 301 with respect to the hand 100 is the index finger 101 in the embodiment; however, the mounting position is not limited. For example, the thumb, the middle finger, the ring finger, or the little finger may be used as the mounting position.

Fourth Embodiment

Figure 10:
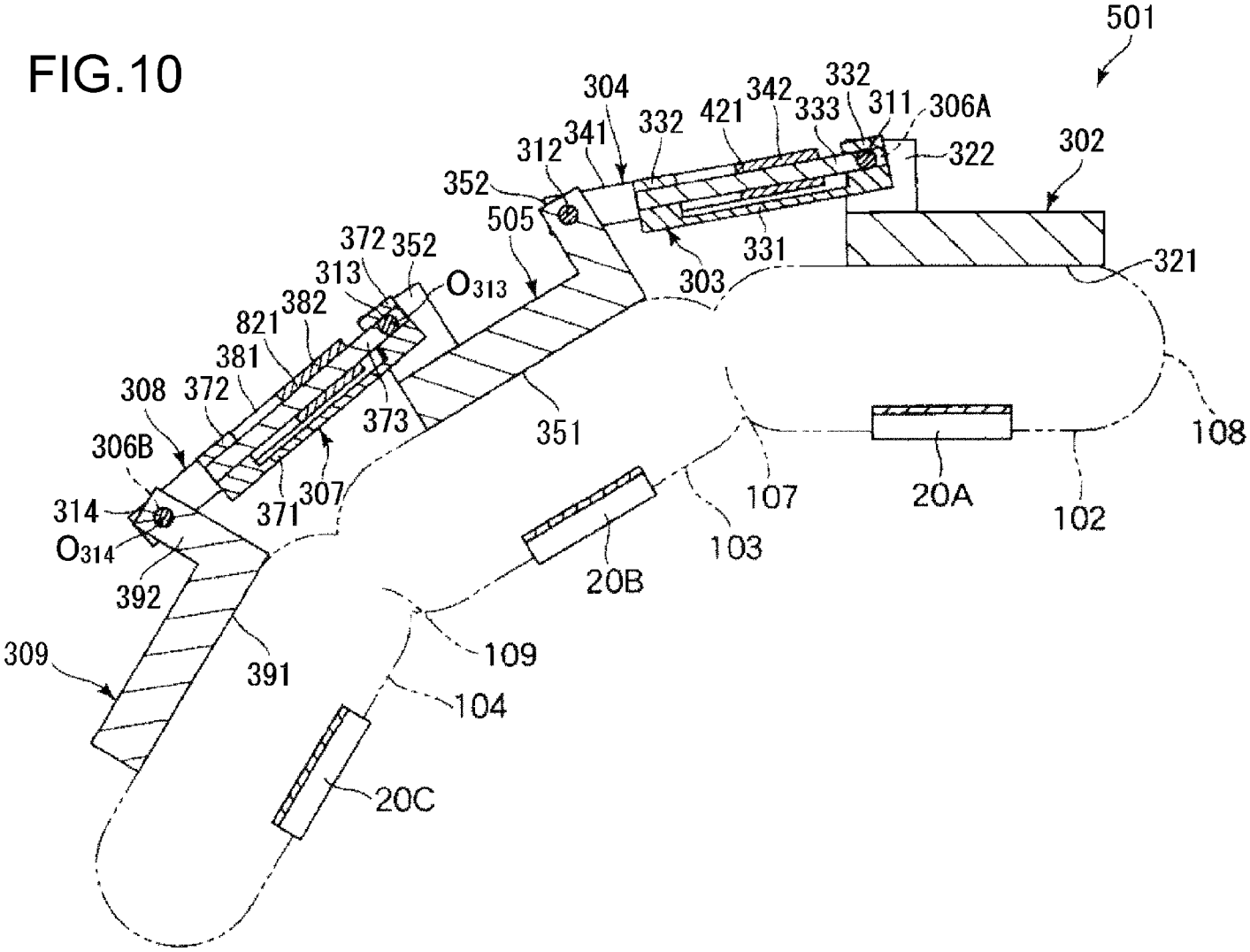
FIG. 10 is a cross-sectional view illustrating a usage state of a finger joint driving device according to a fourth embodiment.

FIG. 10 is a cross-sectional view illustrating a usage state of a finger joint driving device according to a fourth embodiment.

Hereinafter, a finger joint driving device 501 of the fourth embodiment will be described with reference to FIG. 10, but the description will focus on the differences from the embodiments described above and the same matters will be omitted.

According to the embodiment is configured to bend and stretch not only the proximal interphalangeal joint 107 but also the distal interphalangeal joint 109, and the end portion on the end side of the finger of the second base portion 505 is connected to the third link portion (the fifth member) 307, and thus is the same as the finger joint driving device 301 in the third embodiment other than a point that the thickness is large compared with the second base portion 305 in the third embodiment.

As illustrated in FIG. 10, the finger joint driving device 501 is provided with a third link portion (the fifth member) 307, a fourth link portion (the sixth member) 308, and a third base portion (the seventh member) 309 in addition to the first base portion 302, the first link portion 303, the second link portion 304, and the second base portion 305, and these members are connected to each other in order from the wrist side to the end side of the finger.

The third base portion 309 is disposed on the end side of the finger from the second base portion 305 (the third link portion 307) in the mounted state, that is, disposed on the back of the hand 105 side of the distal phalanx 104 of the index finger 101. Accordingly, as will be described later, it is possible to bend and stretch the proximal interphalangeal joint 109 between the middle phalanx 103 and the distal phalanx 104 of the index finger 101 by using the finger joint driving device 501.

Similar to the second base portion 305 in the third embodiment, the third base portion 309 is a member which is formed into a flat block shape. In addition, a surface 391 which comes into contact with the distal phalanx 104 of the third base portion 309 is preferably bent along the shape of the distal phalanx 104. Accordingly, the third base portion 309 is disposed on the distal phalanx 104 without giving a sense of discomfort to the user of the finger joint driving device 501. Further, the third base portion 309 is stably disposed with respect to the distal phalanx 104.

In addition, the third base portion 309 is mounted on the distal phalanx 104 of the index finger 101 by using a mounting band 20C. Since the configuration of the mounting band 20C is the same as that in the second embodiment, the description will be omitted. The mounting band 20C can allow the third base portion 309 to be adhered to the distal phalanx 104 by going around a palm of the hand 106 side of the distal phalanx 104 of the index finger 101. Therefore, it is possible to prevent the third base portion 309 from being separated from the distal phalanx 104.

The third link portion 307 is provided on the end side of the finger of the second base portion 505. The third link portion 307 is a member having the same total length as that of the first link portion 303. The third link portion 307 includes a bottom plate 371 which is formed into a rectangular shape in a planar view and projections 372 which are projected from four corners of the bottom, plate 371. The convex portion 352 of the second base portion 505 is interposed between two projections 372 on the second base portion 505 side.

Further, two projections 372 on the second base portion 505 side and the convex portion 352 of the second base portion 505 are connected to each other via a turning support portion 313. The turning support portion 313 is configured to have an axis which is provided on one of each of the projections 372 and the second base portion 505 of the back of the hand 105 side and a bearing which has the axis inserted therein and is provided on the other of each of the projections 372 and the second base portion 505 of the back of the hand 105 side.

In addition, when a turning axis $O_{109}$ is assumed when the distal interphalangeal joint 109 is turned by bending and stretching, a turning axis $O_{313}$ of the turning support portion 313 is in parallel with the turning axis $O_{109}$. With such a configuration, the third link portion 307 can be turned around the turning axis $O_{313}$ with respect to the second base portion 505 by the turning support portion 313.

In addition, each of rail portions 373 is installed between two projections 372 which are positioned on the thumb side in the mounted state and between two projections 372 which are positioned on the middle finger in the mounted state.

A fourth link portion 308 is provided on the end side of the finger of the third link portion 307. The fourth link portion 308 is a member of turning with respect to the third base portion 309.

In addition, the fourth link portion 308 includes a linear long length portion 381 and a pair of the projection portions 382 which are projected from the long length portion 381, and is formed of a plate piece of which an external shape is substantially a T shape. Specifically, a pair of the projection portions 382 are projected in the direction intersecting with the lateral direction of the long length portion 381 from the end portion of the second base portion 505 side of the long length portion 381, and projected toward the opposite sides.

In addition, each of the projection portions 382 includes a hollow portion 821 which is penetrated in a cylindrical shape and a pair of rail portions 373 of the third link portion 307 are respectively inserted into each of the hollow portions 821.

Similar to the first link portion 303 and the second link portion 304 illustrated in FIG. 8 and FIG. 9, since the projection portion 382 slides while being guided by the rail portion 373, the fourth link portion 308 can relatively approach with respect to and be separated from the second base portion 505 as illustrated in FIG. 10.

Meanwhile, the total length of the rail portion 373 is sufficiently longer than the total length of the projection portion 382, for example, it is preferably 1.5 times to 3 times the total length of the projection portion 382, and more preferably 1.5 times to 2 times.

The tip end portion of the long length portion 381 is interposed between a pair of the convex portions 392 of the third base portion 309. Then, tip end portion of the long length portion 381 and each of the convex portions 392 are connected to each other via a turning support portion 314. The turning support portion 314 is configured to have an axis which is provided on one of the end portion of the long length portion 381 and each of the convex portions 392 and a bearing which has the axis inserted therein and is provided on the other of the end portion of the long length portion 381 and each of the convex portions 392. In addition, a turning axis $O_{314}$ of the turning support portion 314 is in parallel with the turning axis $O_{109}$.

With such a configuration, similar to the third link portion 307, the third base portion 309 can be turned around the turning axis $O_{314}$ which is in parallel with the turning axis $O_{109}$ by the turning support portion 314. Since the turning axis $O_{313}$ and the turning axis $O_{314}$ are in parallel with the turning axis $O_{109}$, it is possible to easily bend and stretch the proximal interphalangeal joint 109 by the finger joint driving device 501 while preventing unnecessary force from being applied to the proximal interphalangeal joint 109.

Configuration materials of the third link portion 307, the fourth link portion 308, and the third base portion 309 are not particularly limited, for example, it is possible to use the same configuration materials as those of the first base portion 302. In addition, configuration materials of the mounting band 20C is not particularly limited, for example, it is possible to use the same configuration materials as those of the mounting band 20A.

In addition, as illustrated in FIG. 10, the finger joint driving device 501 is further provided with the driving unit (the second driving unit) 306B in the vicinity of the pair of convex portions 392 of the third base portion 309.

The driving unit 306B is a mechanical portion which functions for driving the third base portion 309 to be turned via the turning support portion 314. In addition, the proximal interphalangeal joint 107 and the distal interphalangeal joint 109 of the index finger 101 are separated from each other or synchronized to each other by the driving unit 306A and the driving unit 306B, and thus can be reliably turned. Accordingly, since joint portions that assist the user, the operation of the hand becomes easier.

Meanwhile, similar to the configuration of the driving unit 306A, the driving unit 306B is configured to include, that is, the first rotor 61, the second rotor 62, the third rotor 63, and the piezoelectric motor 64 which causes the third rotor 63 to rotate. Therefore, it is possible to use common components in the configuration components of the driving unit 306A and the driving unit 306B, and thus, it is possible to reduce the manufacturing cost of the finger joint driving device 501.

In addition, the driving unit 306B functions for driving the third base portion 309 to be turned in the embodiment, but may function for driving the third link portion 307 to be turned.

As described above, embodiments of the finger joint driving device according to the invention was explained; however, the invention is not limited thereto, each portion configuring the finger joint driving device can be replaced with that of the arbitrary configuration capable of exhibiting the same function. In addition, the arbitrary components may be added to the invention.

In addition, the finger joint driving device according to the invention may be a combination of any two or more configurations (features) in the embodiments described above.

In addition, the first driving unit can serve of driving the second member (the first link portion) and the third member (the second link portion) to be turned in the first embodiment and the second embodiment, but the first driving unit can also serve of driving the fourth member (the second base portion) to approach with respect to and to be separated from the first member (the first base portion).

Further, the first driving unit can serve of driving the second member (the first link portion) and the fourth member (the second base portion) to be turned in the third embodiment and the fourth embodiment, but the first driving unit can also serve of driving the third member (the second link portion) to approach with respect to and to be separated from the first member (the first base portion).

In addition, the second driving unit can serve of driving the fifth member (the third link portion) and the sixth member (the fourth link portion) to be turned in the second embodiment, but the second driving unit can also serve of driving the seventh member (the third base portion) to approach with respect to and to be separated from the fourth member (the second base portion).

Further, the second driving unit can serve of driving the fifth member (the third link portion) and the seventh member (the third base portion) to be turned in the fourth embodiment, but the second driving unit can also serve of driving the sixth member (the fourth base portion) to approach with respect to and to be separated from the fourth member (the second base portion).

The entire disclosures of Japanese Patent Application Nos. 2014-040155, filed Mar. 3, 2014 and 2014-053136, filed Mar. 17, 2014 are expressly incorporated by reference herein.

What is claimed is:

1. A finger joint driving device which is configured to be provided on a hand having a finger including a finger joint, and configured to cause the finger joint to be turned, the finger joint driving device comprising:

a first member that is configured to be mounted on the hand;

a second member that is directly pivotably connected to the first member;

a third member that is directly pivotably connected to the second member;

a fourth member that is configured to be mounted on an end side of the finger from the first member, and is directly slidably connected to the third member so as to be movable towards and away from the first member; and a first driving unit that drives at least one of the second member to be pivoted, the third member to be pivoted, and the fourth member to move towards and away from the first member.

2. The finger joint driving device according to claim 1, wherein the first member is configured to be disposed on a back of the hand and the fourth member is configured to be disposed on a knuckle of the finger.

3. The finger joint driving device according to claim 1, wherein the first member is configured to be disposed on a knuckle of the finger and the fourth member is configured to be disposed on a middle phalanx of the finger.

4. The finger joint driving device according to claim 1, wherein the first member is configured to be disposed on a middle phalanx of the finger and the fourth member is configured to be disposed on a distal phalanx of the finger.

5. The finger joint driving device according to claim 1, wherein the second member and the third member are configured to rotate about an axis that is in parallel with a turning axis of the finger joint.

6. The finger joint driving device according to claim 1, wherein the first driving unit drives the second member to be turned.

7. The finger joint driving device according to claim 1, wherein the first driving unit drives the third member to be turned.

8. The finger joint driving device according to claim 1, wherein the first driving unit includes a piezoelectric element.

9. The finger joint driving device according to claim 1, further comprising:

a fifth member that is turnably provided on the fourth member;

a sixth member that is turnably provided on the fifth member; and a seventh member that is configured to be mounted on the end side of the finger from the fourth member of the hand and is provided on the sixth member so as to relatively approach with respect to and to be separated from the fourth member.

10. The finger joint driving device according to claim 9, further comprising:

a second driving unit that drives at least one of the fifth member to be turned, the sixth member to be turned, and the seventh member to approach with respect to and to be separated from the fourth member.

11. A finger joint driving device which is configured to be provided on a hand having a finger that includes a finger joint, and is configured to cause the finger joint to be turned, the finger joint driving device comprising:

a first member that is configured to be mounted on the hand;

a second member that is directly pivotably connected to the first member;

a third member that is directly pivotably connected to the second member;

a fourth member that is configured to be mounted on an opposite side of an end side of the finger from the first member and is directly slidably connected to the third member so as to be movable towards and away from the first member; and a first driving unit that drives at least one of the second member to be pivoted, the third member to be pivoted, and the fourth member to move towards and away from the first member.

* * * * *